United States Patent [19]

Herrington et al.

[11] Patent Number: 4,906,108

[45] Date of Patent: Mar. 6, 1990

[54] CORRUGATED STICKY TAPE BAG TIE CLOSURE

[75] Inventors: Fox J. Herrington, Holcomb; Eric A. St. Phillips, Fairport, both of N.Y.

[73] Assignee: Mobil Oil Corporation, New York, N.Y.

[21] Appl. No.: 320,632

[22] Filed: Mar. 8, 1989

[51] Int. Cl.[4] ..... B65D 33/16; B65D 33/28

[52] U.S. Cl. ..... 383/71; 206/813; 156/291; 24/30.5 R; 24/30.5 P; 383/62

[58] Field of Search ..... 383/71, 70, 62; 24/30.5 R, 30.5 W, 30.5 P, 30.5 S, 30.5 T; 206/447, 813, 494; 156/291, 205

[56] References Cited

U.S. PATENT DOCUMENTS

| | | | |
|---|---|---|---|
| 2,961,678 | 11/1960 | MacLellan, Jr. et al. | 206/494 X |
| 3,412,926 | 11/1968 | Bostwick | 383/62 |
| 3,806,024 | 4/1974 | Marchesani | 383/62 |
| 4,008,851 | 2/1977 | Hirsch | 383/62 |
| 4,813,794 | 3/1989 | Herrington | 383/75 |

FOREIGN PATENT DOCUMENTS

| | | | |
|---|---|---|---|
| 98075 | 5/1961 | Netherlands | 383/71 |

*Primary Examiner*—Stephen Marcus
*Assistant Examiner*—Jes F. Pascua
*Attorney, Agent, or Firm*—Alexander J. McKillop; Charles J. Speciale

[57] ABSTRACT

A plastic tape is coated with adhesive in alternating spots, then folded in corrugations to cover the spots of adhesive. In use, the tape is manually stretched to expose the adhesive, then wrapped around the neck of a bag to effect a closure.

9 Claims, 1 Drawing Sheet

CORRUGATED STICKY TAPE BAG TIE CLOSURE

FIELD OF THE INVENTION

The present invention relates to bag tie closures for flexible wall bags having a flexible top and particularly a sticky tape bag closure for thermoplastic bags.

BACKGROUND OF THE INVENTION

Bags made of thin polyethylene material have been used in various sizes. Small bags are used in packaging of sandwiches and the like, medium size bags are used for garbage and kitchen trash and larger bags are used for other types of trash such as lawn clippings and leaves. Bags of this type generally include a front wall and back wall and a seam up the sides with an open top. The top is adapted to be closed by twisting and maintained closed by a suitable tie strip or string. The present invention is particularly concerned with a novel bag tie closure for thermoplastic bags. In the past, thermoplastic bags have been provided with various types of tie strips. In some instances the tie strips have been separate strips adapted to be wrapped around the neck of the bag, such strips having openings and notches thereon to effect a closure of the strip around the neck of the bag. In other instances a flat tie strip has been secured to the top of the bag by an adhesive patch so that the tie strip can be removed from the bag and wrapped around the neck of the bag after it has been filled to effect closure of the bag. In other instances, the neck of the bag has been closed by sticky tape and in other instances the bags have been closed by banding the neck of the bag with adhesive. While these various techniques of closing the neck of the bag have been used successfully, they have left something to be desired.

RELATED APPLICATIONS

The present invention is related to the invention disclosed in Herrington application Ser. No. 320,448 entitled "Stretchy Sticky Tape Bag Tie Closure", assigned to the assignee of the present application and concurrently filed herewith. Other related applications directed to draw tape bags include the invention disclosed in Herrington U.S. Pat. No. 4,832,507 entitled "Draw Tape Bag Held Closed by Microencapsulated Adhesive" the invention disclosed in Herrington et al. U.S. Pat. No. 4,842,421 entitled "Thermoplastic Draw Tape Bag with Tacky Closure Surface" and the invention disclosed in Herrington U.S. Pat. No. 4,813,794 entitled "Thermoplastic Draw Tape Bag with Tacky Tape" all assigned to the assignee of the present application.

It is an object of the present invention to provide a corrugated sticky tape bag tie closure for closing the neck of the bag wherein the tape is coated with adhesive at alternating spots, then folded in corrugations to cover the spots of adhesive and in use the tape is manually stretched to expose the adhesive and then wrapped around the neck of the bag to effect a closure.

SUMMARY OF THE INVENTION

In accordance with the present invention there is provided a corrugated sticky tape bag tie closure for closing the neck of the bag. The bag tie closure comprises a tape of plastic material coated on at least one side at alternating areas with a pressure sensitive adhesive, the tape being folded into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugations so that when the tape is wrapped around the neck of the bag, the adhesive is secured to the bag and to the adjacent surface of the tape to effect a closure of the bag. The depth of the corrugations is small relative to the width of the tape so that the corrugated tape can readily be pulled to length thereby separating the adhesive coated areas from the non-coated areas. In a preferred form of the invention, the depth of the corrugations is not greater than about 1/16".

In accordance with another aspect of the invention there is provided a method of making a corrugated sticky tape bag tie closure for closing the neck of the bag. The method comprises the steps of applying to at least one side of a tape of plastic material at alternating areas a pressure sensitive adhesive and folding the tape into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugations so that when the tape is wrapped around the neck of the bag the adhesive is secured to the bag and to the adjacent surface of the tape to effect a closure of the bag.

In accordance with another aspect of the invention, there is provided a thermoplastic bag in combination with a corrugated sticky tape bag tie closure. The thermoplastic bag has two panels forming an open top, closed bottom bag, the panels being joined along the sides of the bag, and a corrugated sticky tape bag tie closure is secured at one end to one of the sides of the bag adjacent the open top thereof, the corrugated sticky tape bag tie closure comprising a tape of plastic material coated on at least one side at alternating areas with a pressure sensitive adhesive, the tape being folded into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugation so that when the tape is wrapped around the neck of the bag the adhesive is secured to the bag and to the adjacent surface of the tape to effect a closure of the bag.

The foregoing and other objects, features and advantages of the invention will be more apparent from the following detailed description and appended claims.

SHORT DESCRIPTION OF THE DRAWINGS

DESCRIPTION OF THE PREFERRED EMBODIMENT

Figure 1:
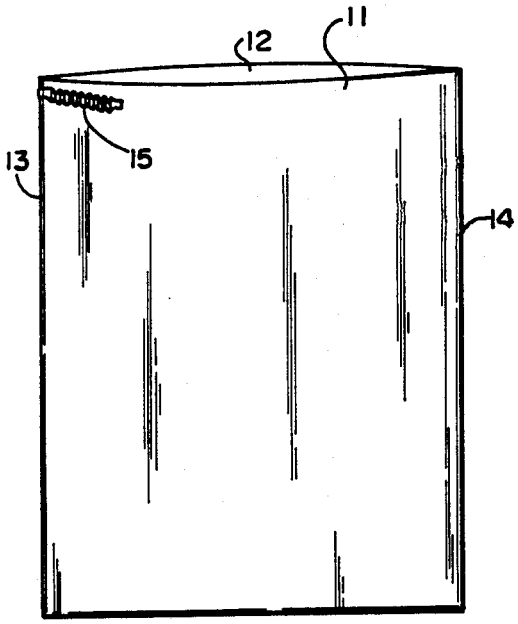
FIG. 1 shows a thermoplastic bag having a corrugated sticky tape bag tie closure embodying the present invention.
Figure 4:
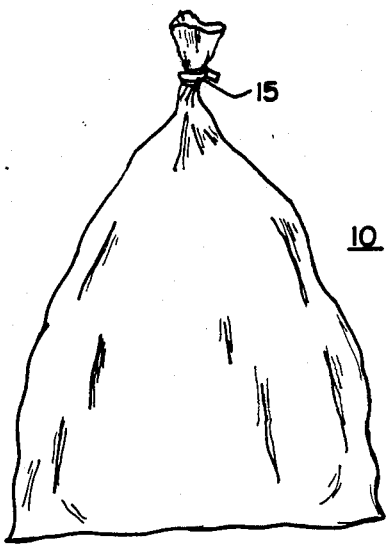
FIG. 4 is a perspective view of a thermoplastic bag similar to FIG. 1 having the corrugated sticky tape bag tie closure wrapped around the neck of the bag to effect closure of the bag.
Figure 2:
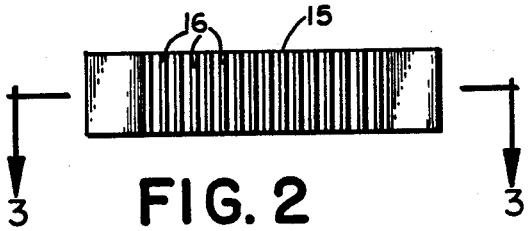
FIG. 2 is a plan view of a corrugated sticky tape bag tie closure embodying the present invention.
Figure 3:
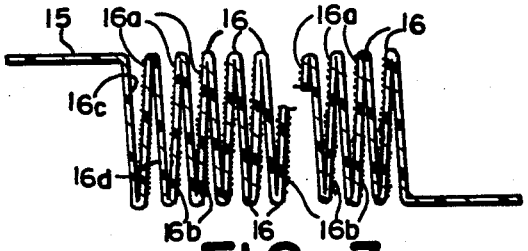
FIG. 3 is a sectional view taken along the lines 3—3 in FIG. 2.

As shown in FIG. 1, the thermoplastic bag 10 includes a front panel 11 and a rear panel 12. The two panels are formed from an extruded tube of polyethylene or other suitable plastic material with a slit along the side to form an open top. The sides of the panels 11 and 12 are heat sealed at 13 and 14 and cut from the tube in a perpendicular direction. As thus far described, bags of this type are well known in the art. As may be seen in FIG. 1, a corrugated sticky tape bag tie closure 15 embodying the present invention has one end thereof secured to the edge 13 adjacent the top of the bag 10. The structure of the bag tie closure 15 shown in FIGS. 1 and 2, is more clearly illustrated in the cross-sectional view of FIG. 3. As shown in FIG. 3, the bag tie closure 15 has applied to both sides of the tape of plastic material at alternating or intermittent areas a pressure sensitive adhesive indicated as 16*a*, 16*b*. The tape is then folded into corrugations 16 at alternating areas so that the adhesive coated areas 16*a*, 16*b* are covered by adjacent noncoated areas 16*c*, 16*d* to prevent exposure of the adhesive while the tape 15 is in the corrugated condition. It will also be noted that the outside ends of the corrugations 16 are not coated with adhesive. Because there is no exposed adhesive when the tape 15 is in its corrugated condition, the tape can be handled easily by the user. When it is desired to close the bag 10, the top of the bag is twisted as shown in FIG. 4 and the tape 15 is pulled lengthwise, opening up the corrugations 16 and exposing the adhesive areas 16*a*, 16*b*. It is then a sticky tape that can be wrapped around the twisted or bunched neck of the bag 10 so that the adhesive is secured to the bag and to the adjacent surfaces of the tape to effect a closure of the bag as shown in FIG. 4. While as shown in FIG. 3 in the preferred form of the invention the pressure-sensitive adhesive has been applied to both sides of the tape at alternating or intermittent areas it can be applied to only one side of the tape.

The depth of the corrugations 16 should be small relative to the width of the tape 15 so that the corrugated strand has the appearance and dimension of a thick piece of tape and can readily be pulled out to its full length. In one embodiment the corrugated tape was made from a polyethylene strip having a thickness of 1–1.5 mils thick and ¼" wide. It was coated with a pressure sensitive adhesive on both sides in an intermittent pattern. The tape was folded into corrugations with non-adhesive areas registered with the adhesive coated areas, so that the adhesive was protected from touching by the user by the adjacent non-adhesive coated layer of film. The depth of the corrugations was not greater than about 1/16" thus providing a corrugated sticky tape bag tie closure having a thickness in the order of about 1/16". While the corrugated sticky tape bag tie closure may be made of any suitable plastic material, it is preferable that it be made of a material which is compatible with the bag material so that they can be chopped up and reclaimed along with the bag in the event any of the bags are defective during manufacture. Thus with polyethylene bas it is preferable that the tape material be polyethylene or high density polyethylene and when the bag material is polypropylene the tape material be polypropylene. When the tap material is not compatible with the bag material, then it is necessary to remove the tapes before reclaiming the material in the defective bags.

Sticky tape is an acceptable closure for thermoplastic bags when the tape is applied by machine so it does not need to be touched, but it is an annoyance in handling a bag. The corrugating of the sticky tape bag tie closure removes this annoyance. This is an alternative technique for achieving the same objective as the stretchy sticky tape bag tie closure disclosed in the aforementioned application Ser. No. 320,448. The corrugation in the tape of the present invention is accomplished by mechanical means, and the selection of tape material is less critical since no reliance is placed on the stretchy characteristic of the tape. It is also believed that it is easier to pull out the corrugations rather than to stretch the tape.

What is claimed is:

1. A corrugated sticky tape bag tie closure for closing the neck of a bag comprising a tape of plastic material coated on at least one side at alternating areas with a pressure-sensitive adhesive, the tape being folded into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugations so that when the tape is wrapped around the neck of the bag the adhesive is secured to the bag and to the adjacent surface of the tape to effect a closure of the bag.

2. A corrugated sticky tape bag tie closure according to claim 1 wherein the tape of plastic material is coated on both sides at alternating areas with pressure-sensitive adhesive.

3. A corrugated sticky tape bag tie closure according to claim 1 wherein the depth of the corrugations is small relative to the width of the tape so that the corrugated tape can readily be pulled out to length thereby separating the adhesive coated areas from the non-coated areas.

4. A corrugated sticky tape bag tie closure according to claim 1 wherein the depth of the corrugations is not greater than about 1/16".

5. The method of making a corrugated sticky tape bag tie closure for closing the neck of a bag comprising the steps of applying on at least one side of a tape of plastic material at alternating areas a pressure sensitive adhesive, and folding the tape into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugations so that when the tape is wrapped around the neck of the bag the adhesive is secured to the bag and to the adjacent surface of the tape to effect a closure of the bag.

6. A method of making a corrugated sticky tape bag tie closure according to claim 5 including the step of applying on both sides of the tape of plastic material at alternating areas a pressure-sensitive adhesive.

7. A method of making a corrugated sticky tape bag tie closure according to claim 5 wherein the depth of the corrugations is small relative to the width of the tape so that the corrugated tape can readily be pulled out to length thereby separating the adhesive coated areas from the non-coated areas.

8. A thermoplastic bag having a corrugated sticky tape bag tie closure comprising a thermoplastic bag having two panels forming an open top, closed bottom bag, said panels being joined along the sides of said bag, and a corrugated sticky tape bag tie closure secured at one end to one of the sides of said bag adjacent the open top thereof, said corrugated sticky tape bag tie closure comprising a tape of plastic material coated on at least one side at alternating areas with a pressure sensitive adhesive, the tape being folded into corrugations at alternating areas so that the adhesive coated areas engage and are covered by adjacent non-coated areas to prevent exposure of the adhesive while the tape is in the corrugated condition and to permit exposing the adhesive when the tape is pulled lengthwise thereby opening up the corrugations so that when the tape is wrapped around the neck of the bag the adhesive is secured to the bag and to the adjacent surface of the tape to effect a closure of the bag.

9. A thermoplastic bag having a corrugated sticky tape bag tie closure according to claim 8 wherein said tape of plastic material is coated on both sides at alternating areas with a pressure-sensitive adhesive.

* * * * *